US005365992A

United States Patent [19]

Swain et al.

[11] Patent Number: 5,365,992

[45] Date of Patent: Nov. 22, 1994

[54] SELF-LOCKING ROOM AIR CONDITIONING PANELS

[75] Inventors: Henry L. Swain, Bridgewater; Glenn J. Gray, Hampton, both of N.J.

[73] Assignee: Illinois Tool Works, Inc., Glenview, Ill.

[21] Appl. No.: 895,088

[22] Filed: Jun. 8, 1992

[51] Int. Cl.[5] ..... E06B 7/02

[52] U.S. Cl. ..... 160/84.1 E; 454/203; 62/262; 52/202

[58] Field of Search ..... 52/202, 203; 62/262; 160/231.2, 35, 40, 84.1 E, 84.1 G, 206, 84.1 R; 454/203

[56] References Cited

U.S. PATENT DOCUMENTS

| | | | |
|---|---|---|---|
| 2,781,717 | 2/1957 | Hord | 454/203 |
| 2,818,793 | 1/1958 | Hord | 454/203 |
| 3,111,076 | 11/1963 | Martin, Jr. et al. | 62/262 |
| 3,373,291 | 3/1968 | Milani | 160/231.2 |
| 3,460,458 | 8/1969 | MacLeod | 454/203 |
| 3,911,803 | 10/1975 | Kong et al. | 98/94 |
| 4,665,964 | 5/1987 | Zommers | 160/84 R |
| 4,724,883 | 2/1988 | Liebowitz | 160/84 R |

*Primary Examiner*—Carl D. Friedman
*Assistant Examiner*—Robert J. Canfield
*Attorney, Agent, or Firm*—Kane, Dalsimer, Sullivan, Kurucz, Levy, Eisele and Richard

[57] ABSTRACT

A room air conditioning unit may be mounted in a window opening using a device, on each side of the unit in the opening, having a straightforward two-piece construction. The first piece is a molded C-shaped frame which straddles the unit from above and below in the opening. A side member of the frame is abutted against the side of the window opening. A lower portion of the frame rests upon the bottom of the window opening, while the window sash is lowered down onto an upper portion of the frame to participate in securing the unit within the opening. The other piece of the device is a panel having a Z-fold central portion. One side of the panel may be attached, for example by screws, to the case or housing of the room air conditioning unit. The other side of the panel self-locks within the side member of the frame, using a locking mechanism provided therewithin, to close the space on either side of the room air conditioning unit within the window opening with the Z-fold central portion of the panel.

18 Claims, 6 Drawing Sheets

SELF-LOCKING ROOM AIR CONDITIONING PANELS

BACKGROUND OF THE INVENTION

1. Field of the Invention

The present invention relates to room air conditioning units, and more particularly to a structure for mounting a room air conditioning unit in a window opening.

2. Description of the Prior Art

Room air conditioners are usually of a cross-sectional area less than that of the window opening in which they are mounted. For this reason, it has long been the practice to provide, either as a separate item or integral with the room air conditioner case, adjustable mounting means for bridging or blocking the space between the case and the adjacent sides of the window opening. Many of these mounting arrangements include a C-shaped frame member movable relative to the air conditioner and including an end member for engaging the window side or jamb and parallel upper and lower leg members. A pleated or accordion-configured sheet is used to block the open space within the extended frame.

In the mounting means of this variety in the prior art, the sheet is permanently attached to the upright portion of the frame and to the case of the air conditioner. This often renders the installation of the unit within the window opening more difficult than need be, because, when the frame is extended to secure the unit within the window opening, the panel can inhibit the persons carrying out the installation by simply getting in the way. The present invention provides an alternative means to mount a room air conditioning unit within a window opening, wherein the panel may be brought across the space within the frame and secured within an upright member thereof by a self-locking means after the unit has been installed.

SUMMARY OF THE INVENTION

The present invention is a means for mounting a room air conditioning unit in a window opening. The means includes a simple two-piece construction on each side of the unit in the window opening.

One piece is a C-shaped frame, an integral structure comprising a vertical side member, a horizontal upper leg, and a horizontal lower leg parallel thereto. The upper and lower legs are both substantially perpendicular to the side member. The upper leg and the lower leg are intended to straddle the room air conditioning unit from above and below, respectively, in the window opening. The side member is, or course, of a length to enable the upper leg and the lower leg to do so. The C-shaped frames on each side, right and left, of the room air conditioning unit in the window opening are mirror images of one another.

The side member, the upper leg, and the lower leg each include a substantially U-shaped channel. The channels in the upper and lower legs face one another, and communicate with the channel in the side member. It follows that the channels in the side member, and upper and lower legs, face inwardly with reference to the C-shape of the frame.

The channel in the side member includes a locking means so that the self-locking room air conditioning panels, which are the second pieces of the two piece construction of the present invention, may be locked thereinto in a convenient manner to close the space on either side of the room air conditioning unit in a window opening.

The self-locking room air conditioning panel includes, in an integral structure, a first end member, a Z-fold central portion, and a second end member. The panel as a whole has a height substantially equal to the length of the channel in the side member of the frame, so that the panel may be held in an upright position within the frame by the channels in the upper leg and lower leg, and may be slidingly translated therewithin.

The first end member of the panel is adapted to be attached to the case or housing of the room air conditioning unit, and to provide an effective seal thereagainst. The second end member, having a width substantially equal to that of the channel in the side member of the frame, cooperates with the locking means therewithin, so that, when the second end member is forced, manually or otherwise, into the channel, it may be engaged by the locking means, which hold the panel across the opening on each side of the room air conditioning unit in a window opening.

The present invention will now be described in more complete detail below with frequent reference being made to the several figures, which may be identified as follows.

DETAILED DESCRIPTION OF THE PREFERRED EMBODIMENT

Figure 1:
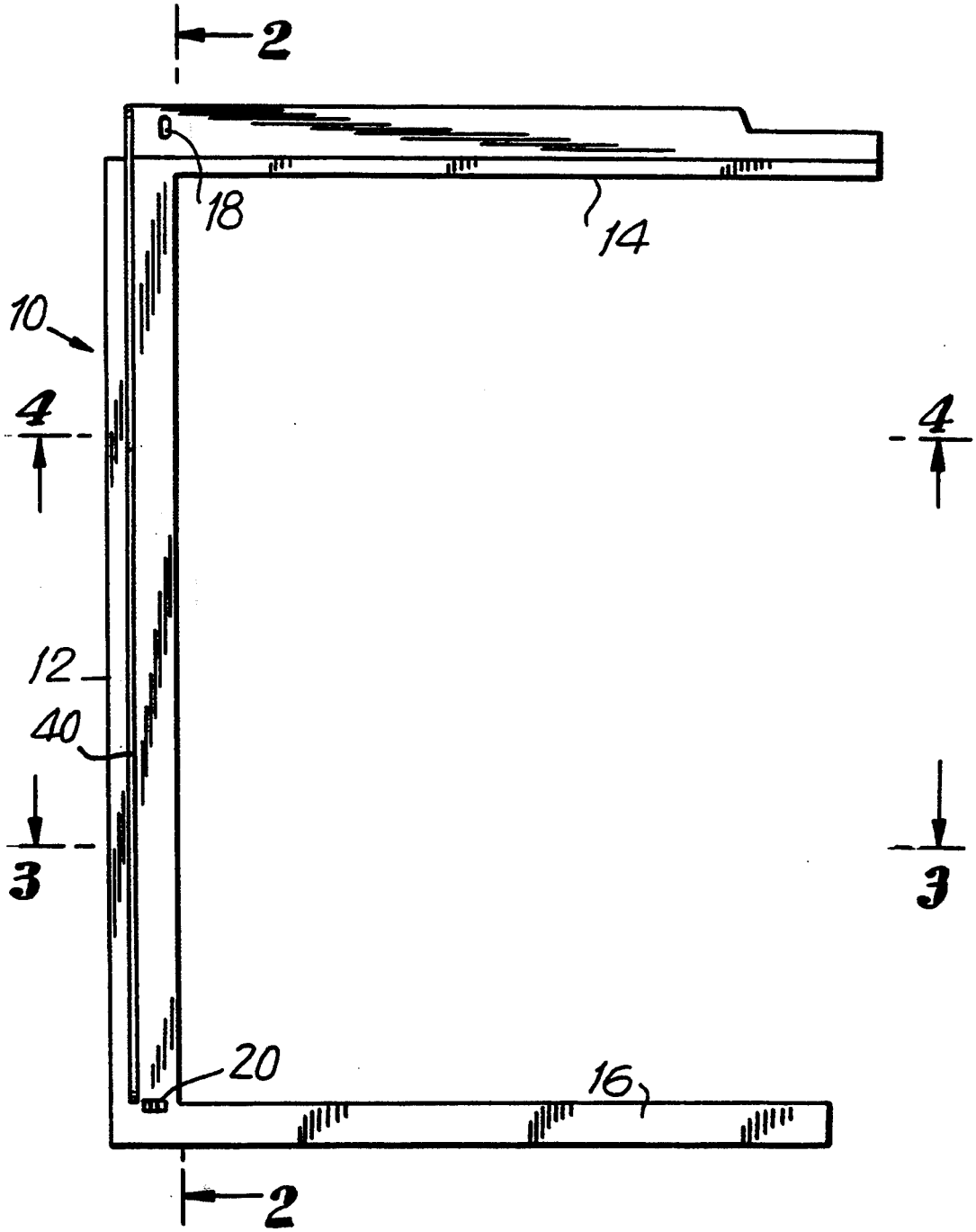
FIG. 1 is a perspective view of a frame which is a part of the present means for mounting a room air conditioning unit in a window opening.

The present means for mounting a room air conditioning unit in a window opening comprises a C-shaped frame 10 as shown in FIG. 1. The frame 10 includes a side member 12, an upper leg 14 and a lower leg 16, the two legs 14,16, which in use straddle an air conditioner in a sliding relationship, being parallel to one another.

The C-shaped frame 10 shown in FIG. 1 is in reality one of two such frames which reside one on each side of the room air conditioning unit in a window opening. FIG. 1 shows the inside view of the frame 10 for the left-hand side of the air conditioner. Side member 12, during deployment in a window opening, abuts against the left-hand side of the window frame. Lower leg 16 rests on the bottom of the window frame. Upper leg 14 cooperates with the window sash, in a manner to be described below, to hold the room air conditioning unit in place in the window frame. Hole 18 in upper leg 14 is provided to enable the user of the present invention to screw the window sash to frame 10, so that the window sash may participate in holding the air conditioner within the window opening, and to prevent the window sash from being raised inadvertently. Preferably, the upper leg 14 and the lower leg 16 of frame 10 are inserted into means provided therefor on the top and bottom surfaces of the air conditioner, straddling the same in a sliding relationship, so that frame 10 may be moved relative to the air conditioner to enable it to be installed within window openings of a variety of different widths. It should be understood that the frame for the right-hand side of the air conditioner may simply be a mirror image of the frame 10 shown in FIG. 1.

The C-shaped frame 10 also includes a screw-guiding tab 20 in that corner of frame 10 where the side member 12 meets the lower leg 16. As suggested by its name, screw-guiding tab 20 provides a means for a screw, driven into the window sill of the window opening in which an air conditioner is being deployed, to hold lower leg firmly against the bottom of the window frame, and, specifically, to the window sill.

Figure 2:
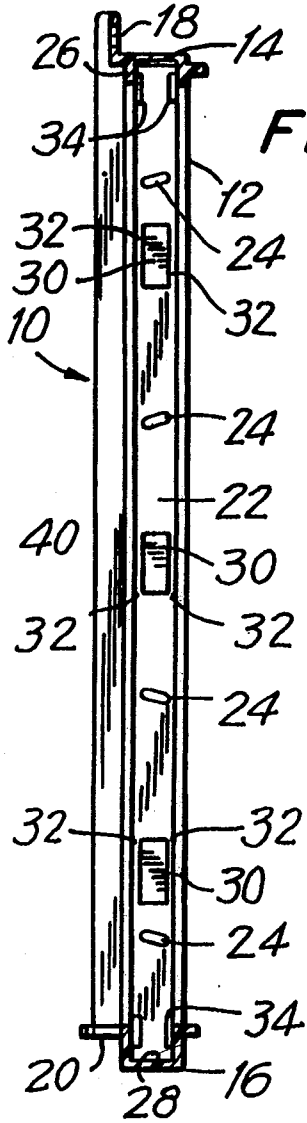
FIG. 2 is a cross section of the frame taken as indicated by line 2—2 in FIG. 1.

FIG. 2 is a cross section of frame 10 taken as indicated by line 2—2 in FIG. 1, and shows that portion of side member 12 which faces the air conditioner. As shown in FIG. 2, side member 12 includes a U-shaped channel 22, which may include a plurality of holes 24, to enable the user of the present invention to screw frame 10 to the side of the window frame.

At the top and bottom of the view of the frame 10 presented in FIG. 2, the upper leg 14 and the lower leg 16 are seen in cross section. As may further be noted, the upper leg 14 forms a U-shaped channel 26, while the lower leg 16 forms a U-shaped channel 28. Channel 28 in lower leg 16 may be deeper, as shown in FIG. 2, then channel 26 in upper leg 14.

Screw-guiding tab 20, viewed from the side in FIG. 2, appears at the lower-left hand side of frame 10. As such, it follows that the left-hand side of the side member 12, as depicted in FIG. 2, is on the interior of the window opening, while the right-hand side is facing outward. As previously noted, screw-guiding tab 20 may rest on the window sill, providing a means for securing the frame 10 to the bottom of the window frame.

Turning now to the top of the side member 12, the top of upper leg 14 may be seen to be L-shaped in FIG. 2. This enables the upper leg 14 to cooperate with a window sash to hold the room air conditioning unit in place in the window frame. Hole 18 in upper leg 14, previously seen in FIG. 1, passes through the upright portion of the L-shape.

With reference to the channel 22 in side member 12, channel 22 may include a plurality of raised rectangular portions 30. It should be understood that portions 30 are raised slightly with respect to the bottom of channel 22. Each raised rectangular portion 30, of which there are shown in FIG. 2, is narrower than the channel 22 as a whole, so that spaces 32 may be provided between each raised rectangular portion 30 and the walls of channel 22.

Also included within channel 22, and specifically on the side walls thereof, are a plurality of pairs of opposed ridges 34, which effectively narrow the width of the channel 22 therebetween. The function of ridges 34, which serve as a locking means, will become apparent as the present invention is described further below.

Figure 3:
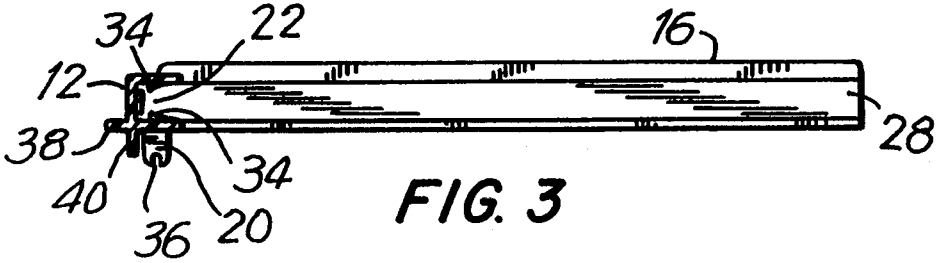
FIG. 3 is a cross section of the frame taken as indicated by line 3—3 in FIG. 1.

FIG. 3 is a cross section of frame 10 taken as indicated by the line 3—3 in FIG. 1, and shows that portion of lower leg 16 which faces upward during use in a window opening. In the view shown in FIG. 3, channel 28 in lower leg 16 may be seen, as well as a portion of side member 12 in cross section.

Seen from the perspective shown in FIG. 3, screw-guiding tab 20 includes a notch 36 which accommodates a screw used to secure the lower leg 16 to a window sill. In addition, at the lower left-hand corner of the view shown in FIG. 3 there is an internal corner 38 formed by projecting member 40, which appears, although viewed from different directions, in both FIGS. 1 and 2. Internal corner 38 allows frame 10 to be firmly justified against the side of the window frame within the window opening before screws are inserted through holes 24 and through notch 36.

Turning again to channel 22 in side member 12, seen in cross section in FIG. 3, a pair of opposed ridges 34 project inwardly into the channel 22 from the side walls thereof, and act as a locking means in a manner to be described below.

Figure 4:
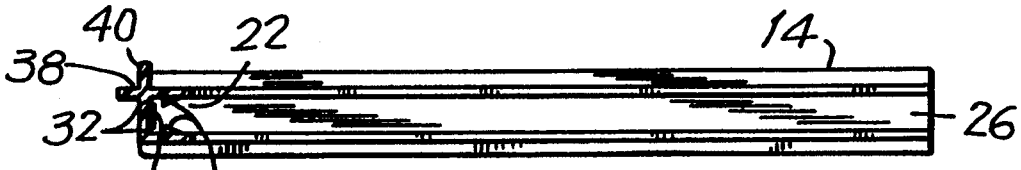
FIG. 4 is a cross section of the frame taken as indicated by 4—4 in FIG. 1.

FIG. 4 is a cross section of frame 10 taken as indicated by line 4—4 in FIG. 1, and shows that portion of upper leg 14 which faces downward during use in a window opening. As a consequence of the direction in which the view shown in FIG. 4 has been taken, that is, from below, that portion of frame 10 on the top of the upper leg 14 faces inwardly with respect to the window opening in which frame 10 is to be used. In the view shown in FIG. 4, channel 26 in upper leg 14 may be seen, as well as a portion of side member 12 in cross section.

In addition, although now in the upper left-hand corner of the view shown in FIG. 4, internal corner 38 is formed by projecting member 40, and allows frame 10 to be firmly justified against the side of the window frame.

Figure 5:
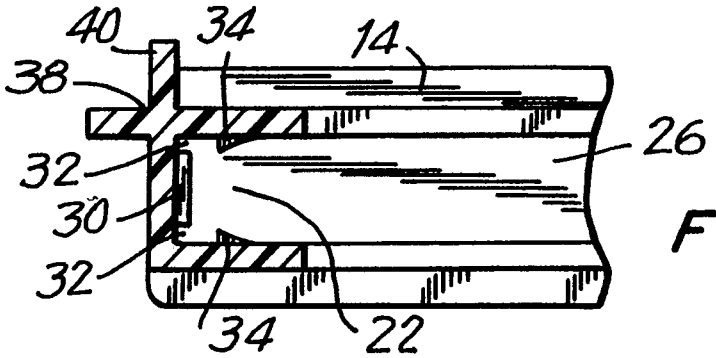
FIG. 5 is an enlarged view of the left-hand side of FIG. 4.

Channel 22 in side member 12, again seen in cross section in FIG. 4, and in an enlarged view of the left-hand side of FIG. 4 presented in FIG. 5, has a pair of opposed ridges 34 projecting thereinto from the side walls thereof. At the bottom of channel 22, and below the pair of opposed ridges 34, is a raised rectangular portion 30 having spaces 32 on both sides thereof. The pair of opposed ridges 34 provide the locking means, alluded to above and to be explained further below.

Before concluding a discussion of C-shaped frame 10, it should be understood that said frame 10, including all its above-described elements, is an integral piece molded from a thermoplastic or thermosetting synthetic polymeric resin, such as, for example, polystyrene.

Figure 6:
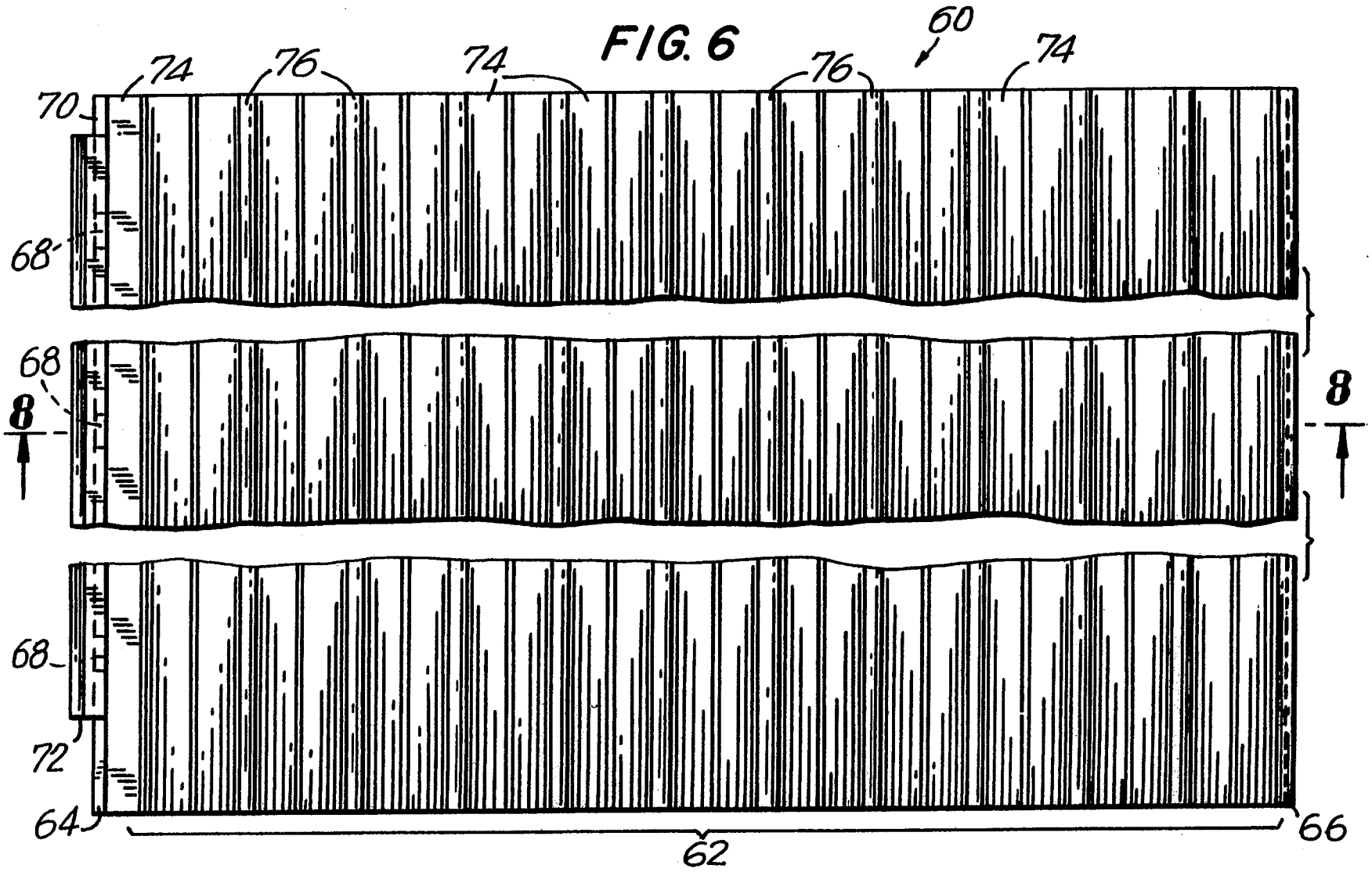
FIG. 6 is a side plan view of the self-locking room air conditioning panel of the present invention.

A self-locking room air conditioning panel 60 of the present invention is shown in side plan view in FIG. 6. Essentially, the panel 60 comprises a Z-fold central portion 62 with a first end member 64 and a second end member 66. The first end member 64 is designed, in view of the screw holes 68 directed therethrough, to be screwed to the case or housing of the room air conditioning unit, while the second end member 66 locks into channel 22 of side member 12 in C-shaped frame 10. It follows, as a consequence of the view presented in FIG. 6, that the panel 60 shown belongs on the right-hand side of an air conditioner. It goes without saying that a panel for the left-hand side would be the mirror-image of that presented in FIG. 6.

It will be noted that the first end member 64 shown in FIG. 6 has an upper notch 70 at its upper end and a lower notch 72 at its lower end. Notches 70,72 may be provided because panel 60 is substantially equal in height to that of channel 22 in side member 12 of frame 10, and because first end member 64 may be wider than channel 26 in upper leg 14 and channel 28 in lower leg 16. Notches 70,72 then may be required to trim the width of first end member 64 to be substantially equal to that of channel 26 and of channel 28, respectively.

It will be observed that notch 72 at the bottom of first end piece 64 may be longer than notch 70 at the top of first end piece 64. Such may be required, for example, where channel 28 is deeper than channel 26.

Figure 7:
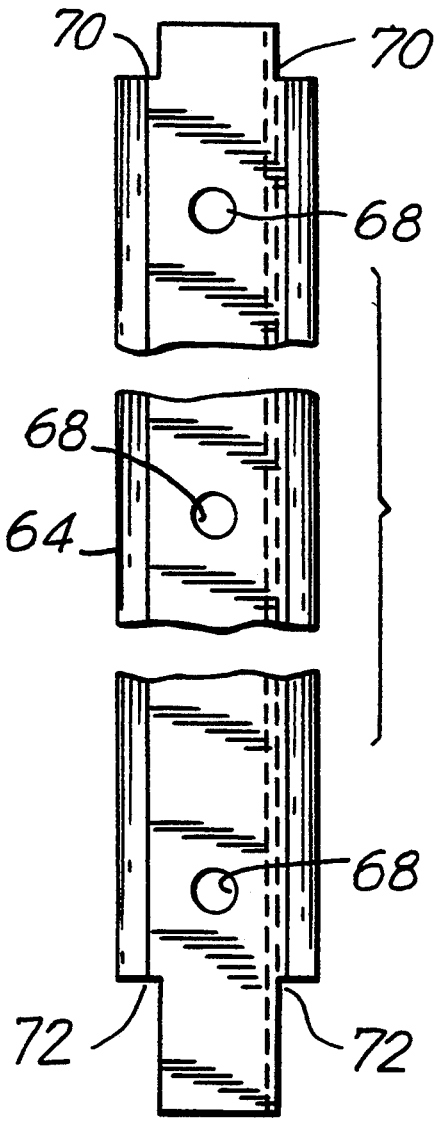
FIG. 7 is a perspective view of one end of the self-locking room air conditioning panel.

Digressing for a moment from FIG. 6, FIG. 7 presents a perspective view of first end member 64, and shows that two notches 70 may be provided at the upper end thereof, while two notches 72 may be provided at the lower end thereof. Holes 68, directed more or less through the first end member 64 at points along its centerline, are more clearly shown in FIG. 7 than in FIG. 6, and are provided, as noted above, so that first end member 64 may be screwed to the case or housing of an air conditioner.

Returning now to a discussion of FIG. 6, the Z-fold central portion 62 of panel 60 comprises a plurality of substantially planar sections 74 joined together by a plurality of hinge elements 76. In the view presented in FIG. 6, some hinge elements 76 appear to be wider than others. This is a consequence of FIG. 6 being a side view of panel 60, wherein one-half of the apexes in the Z-fold point toward the viewer, while the other half point away. Those hinge elements 76 which appear wider in FIG. 6 are merely those directed toward the viewer thereof, and appear broader for this reason.

Figure 8:
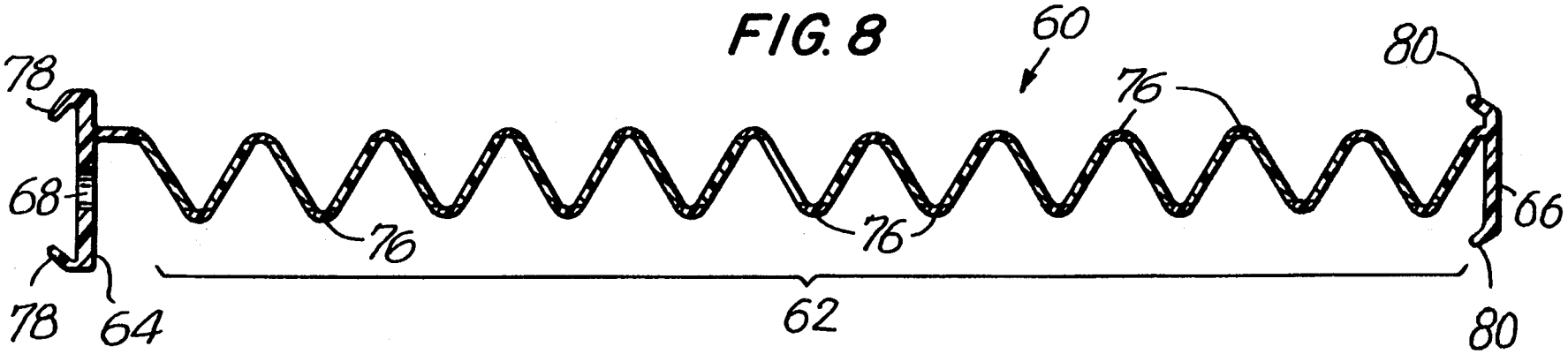
FIG. 8 is a cross section of the panel taken as indicated by line 8—8 in FIG. 6.

FIG. 8 is a cross section of panel 60 taken as indicated by line 8—8 in FIG. 6. First end member 64, appearing on the left side of FIG. 8, is a substantially planar member with two inwardly curving edgewise flanges 78. It will be recalled that first end member 64 may be screwed to the case or housing of an air conditioner through the provision of holes 68 for this purpose. When so attaching first end member 64 to the case, flanges 78 are compressed and flattened thereagainst to effectively seal one against the other in an air-tight fashion.

The Z-fold central portion 62 of panel 60, in the cross section shown in FIG. 8, may be seen more clearly as comprising a plurality of substantially planar sections 74 joined together by a plurality of hinge elements 76.

At the right-hand side of FIG. 8, second end member 66 may be seen to be a substantially planar member including two outwardly directed edgewise flanges 80. Flanges 80 cooperate with the plurality of pairs of opposed ridges 34 in channel 22 of side member 12 in frame 10 to provide a locking means for securing second end member 66 into that channel 22 in a manner to be illustrated below.

Figure 9:
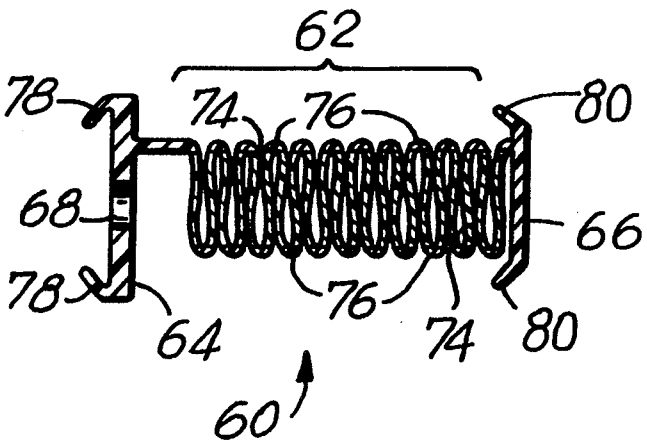
FIG. 9 shows the panel in a fully compressed state in a cross section analogous to that of FIG. 8.

FIG. 9, for the purposes of illustration, shows a panel 60 as it would appear in cross section when fully compressed. The component parts of panel 60 have been identified using the same reference numbers as are used in FIGS. 6, 7 and 8 to facilitate the making of comparison therebetween.

Panel 60, despite reference above to hinge elements 76, is an integral structure dual extruded from two varieties of polymeric material. First end member 64, second end member 66, and the plurality of substantially planar sections 74 may comprise ethylene-vinyl acetate (EVA), while hinge elements 76 may comprise thermoplastic rubber (TPR). Both polymers may include a UV stabilizer.

Figure 10:
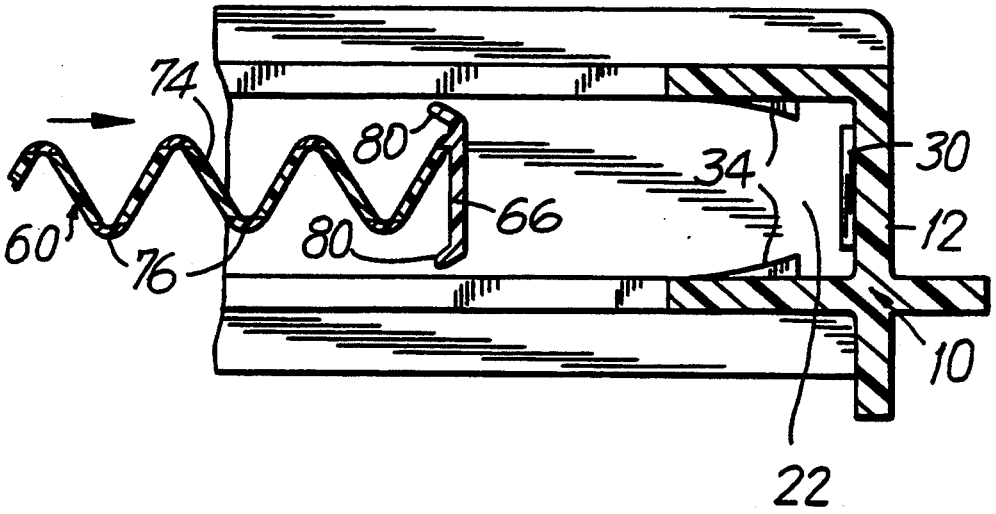
FIGS. 10 and 11 illustrate the self-locking mechanism for securing the other end of the panel into the frame.
Figure 11:
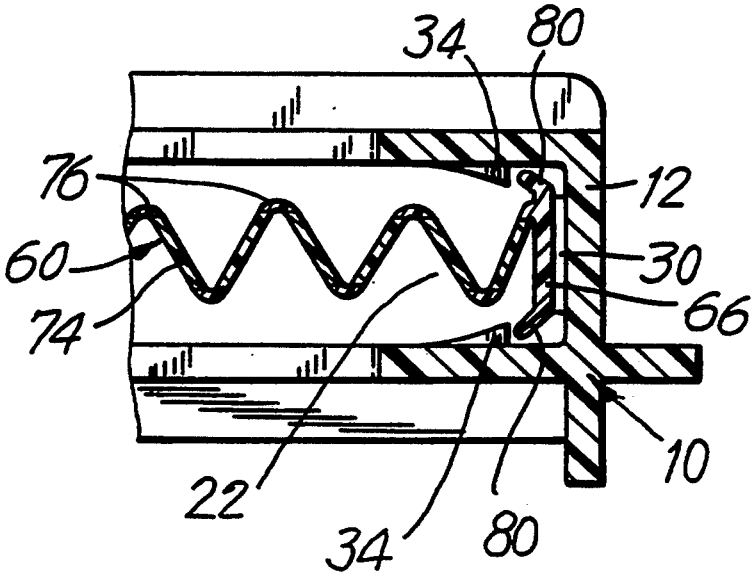

FIGS. 10 and 11 illustrate the cooperation between flanges 80 on second end member 66 of panel 60 and a pair of opposed ridges 34 in channel 22 of side member 12 in frame 10 before and after one is locked into the other respectively. Panel 60, dual extruded from two resilient polymers, may be manually directed into channel 22 in the manner suggested by FIGS. 10 and 11. When flanges 80 encounter the pair of opposed ridges 34, they are forced inwardly but spring back outwardly when they have passed said ridges 34 to lock second end member 66 of panel 60 into channel 22. In this manner, the self-locking character of the present room air conditioning panels is provided.

Modifications to the above would be obvious to those of ordinary skill in the art, but would not bring the invention so modified beyond the scope of the appended claims.

What is claimed is:

1. Means for mounting a room air conditioning unit in a window opening comprising:

a C-shaped frame, said frame including a side member, an upper leg, and a lower leg; said upper leg and said lower leg being parallel to one another and substantially perpendicular to said side member, said upper leg and said lower leg being adapted to straddle said room air conditioning unit from above and below, respectively, in said window opening; said side member, said upper leg and said lower leg each including a substantially U-shaped channel, said channel in said upper leg facing said channel in said lower leg, and said channel in said side member communicating with said channels in said upper leg and said lower leg; said channel in said side member having at least one pair of opposed ridges, said opposed ridges narrowing said channel in the space therebetween; and a self-locking room air conditioning panel, said panel including a substantially planar first end member having a pair of inwardly curving edgewise flanges, a Z-fold central portion, and a second end member; said panel having a height substantially equal to the length of said channel in said side member of said frame, so that said panel may be held in an upright position within said frame between said channel sin said upper leg and said lower leg; said first end member being adapted to be attached to said room air conditioning unit so that an air-tight seal may be formed between said panel and said air conditioning unit when said first end member is attached to said air conditioning unit; said second end member having a width substantially equal to the width of said channel in said side member of said frame, and being a substantially planar member having a pair of outwardly directed edgewise flanges, said flanges being engagable by said at least one pair of opposed ridges in said channel of said side member, so that said second end member may be locked within said channel of said side member by an interference fit of said flanges behind said opposed ridges.

2. Means for mounting a room air conditioning unit as claimed in claim 1 wherein said upper leg of said frame has an L-shaped top surface, so that a window sash may be lowered thereunto in a window opening and abutted thereagainst.

3. Means for mounting a room air conditioning unit as claimed in claim 2 wherein said L-shaped top surface includes a hole therethrough through which a fastening means may be driven to secure said upper leg of said frame to said window sash.

4. Means for mounting a room air conditioning unit as claimed in claim 1 wherein said channel in said side member of said frame includes at least one hole therethrough through which a fastening means may be driven to secure said side member of said frame to a side of a window opening.

5. Means for mounting a room air conditioning unit as claimed in claim 1 wherein said side member of said frame includes a screw-guiding tab projecting outwardly therefrom, said tab having a notch through which a fastening means may be driven to secure said frame to a window sill.

6. Means for mounting a room air conditioning unit as claimed in claim 1 wherein said lower leg of said frame includes a screw-guiding tab projecting outwardly therefrom, said tab having a notch through which a fastening means may be driven to secure said frame to a window sill.

7. Means for mounting a room air conditioning unit as claimed in claim 1 wherein said side member of said frame includes an elongated projecting member forming a corner on a surface of said side member, so that said frame may be abutted against a side of said window opening.

8. Means for mounting a room air conditioning unit as claimed in claim 1 wherein said frame is an integral piece injection-molded from a synthetic polymeric resin.

9. Means for mounting a room air conditioning unit as claimed in claim 1 wherein said first end member has at least one hole directed therethrough through which a fastening means may be driven to attach said first end member to said air conditioning unit.

10. Means for mounting a room air conditioning unit as claimed in claim 1 wherein said Z-fold central portion of said panel includes a plurality of substantially planar sections joined to one another by a plurality of hinge elements.

11. Means for mounting a room air conditioning unit as claimed in claim 10 wherein said panel is an integral structure extruded from polymeric material, 12. Means for mounting a room air conditioning unit as claimed in claim 11 wherein said polymeric material includes a UV stabilizer, 13. Means for mounting a room air conditioning unit as claimed in claim 10 wherein said panel is an integral structure dual extruded from a first polymeric material and a second polymeric material, said first polymeric material forming said first end member, said second end member and said plurality of substantially planar sections of said Z-fold central portion of said panel, and said second polymeric material forming said plurality of hinge elements, 14. Means for mounting a room air conditioning unit as claimed in claim 13 wherein said first polymeric material is ethylene-vinyl acetate (EVA).

15. Means for mounting a room air conditioning unit as claimed in claim 13 wherein said first polymeric material includes a UV stabilizer.

16. Means for mounting a room air conditioning unit as claimed in claim 13 wherein said second polymeric material is thermoplastic rubber (TPR).

17. Means for mounting a room air conditioning unit as claimed in claim 13 wherein said second polymeric material includes a UV stabilizer.

18. Means for mounting a room air conditioning unit in a window opening comprising:

a C-shaped frame, said frame including a side member, an upper leg, and a lower leg; said upper leg and said lower leg being parallel to one another and substantially perpendicular to said side member, said upper leg and said lower leg being adapted to straddle said room air conditioning unit from above and below, respectively, in said window opening; said side member, said upper leg and said lower leg each including a substantially U-shaped channel, said channel in said upper leg facing said channel in said lower leg, and said channel in said side member communicating with said channels in said upper leg and said lower leg; said channel in said side member having at least one pair of opposed ridges, said opposed ridges narrowing said channel in the space therebetween; and a self-locking room air conditioning panel, said panel including a first end member, a Z-fold central portion, and a second end member; said panel having a height substantially equal to the length of said channel in said side member of said frame, so that said panel may be held in an upright position within said frame between said channels in said upper leg and said lower leg; said first end member having a width greater than the widths of said channels in said upper leg and said lower leg and being provided with notches where said first end member engages with said channels of said upper leg and said lower leg, so that said width of said first end member in said channels may be substantially equal to the widths of said channels, said first end member being adapted to be attached to said room air conditioning unit; said second end member having a width substantially equal to the width of said channel in said side member of said frame, and being a substantially planar member having a pair of outwardly directed edgewise flanges, said flanges being engagable by said at least one pair of opposed ridges in said channel of said side member, so that said second end member may be locked within said channel of said side member by an interference fit of said flanges behind said opposed ridges.

* * * * *